US008336240B2

(12) United States Patent
Gray et al.

(10) Patent No.: US 8,336,240 B2
(45) Date of Patent: Dec. 25, 2012

(54) TWO-PIECE WRISTBAND WITH INTERCHANGEABLE BAND ELEMENT FOR USER SELECTABLE SIZING

(75) Inventors: Jo A. Gray, Orlando, FL (US); John David Worrall, Clermont, FL (US)

(73) Assignee: Disney Enterprises, Inc., Burbank, CA (US)

( * ) Notice: Subject to any disclaimer, the term of this patent is extended or adjusted under 35 U.S.C. 154(b) by 461 days.

(21) Appl. No.: 12/706,196

(22) Filed: Feb. 16, 2010

(65) Prior Publication Data

US 2011/0197483 A1 Aug. 18, 2011

(51) Int. Cl.
*A44C 5/00* (2006.01)

(52) U.S. Cl. ..... 40/633; 40/665; 63/3.2; 63/1.13

(58) Field of Classification Search ..... 40/633, 40/665; 63/3.2, 1.13
See application file for complete search history.

(56) References Cited

U.S. PATENT DOCUMENTS

| | | | | | |
|---|---|---|---|---|---|
| 1,214,135 | A | * | 1/1917 | Clark | 59/80 |
| 1,440,230 | A | * | 12/1922 | Mestekin | 59/80 |
| 3,604,203 | A | * | 9/1971 | Hofmann | 59/80 |
| D243,665 | S | * | 3/1977 | Laurent | D11/12 |
| 4,742,503 | A | | 5/1988 | Braun et al. | |
| 4,906,025 | A | | 3/1990 | Schreindl | |
| 5,065,376 | A | | 11/1991 | Choulat | |
| 5,416,953 | A | | 5/1995 | Hui | |
| 7,041,032 | B1 | | 5/2006 | Calvano | |
| 7,348,888 | B2 | | 3/2008 | Girvin | |
| 7,481,370 | B2 | | 1/2009 | Davis | |
| 2005/0108912 | A1 | | 5/2005 | Bekker | |
| 2008/0224822 | A1 | * | 9/2008 | Gelman et al. | 340/5.2 |
| 2009/0096614 | A1 | | 4/2009 | Singleton et al. | |

OTHER PUBLICATIONS

Wristloks, http://www.adsources.com/CATALOG/wristlocks.htm, retrieved on Dec. 14, 2009, Wristlocks Wristbands.

Synometrix, http://www.synometrix.com/china_taiwan_rfid_bracelets.shtml, RFID Wristbands & RFID Bracelets & FRID Bracelet Manufacturers China Asia, retrieved on Dec. 14, 2009.

* cited by examiner

*Primary Examiner* — Casandra Davis
(74) *Attorney, Agent, or Firm* — Marsh Fischmann & Breyfogle, LLP; Kent A. Lembke

(57) ABSTRACT

A wearable band with an adjustable size or length. The assembly includes a base band element with a body extending from a first end to a second end containing an RFID module. The assembly includes a sizing band element for sizing the assembly to a particular wrist size. The band assembly includes an interlocking fastener that slidably couples the base band element to the sizing band element so as to define a one-piece band with a desired length/size. The interlocking fastener includes a first portion provided on the second end of the base band element body and a second portion on an end of the sizing band element body. The fastener may be a tongue and groove mechanism, with the first portion being a tongue member extending from the base band body and with the second portion being a groove in the end of the sizing band body.

9 Claims, 8 Drawing Sheets

TWO-PIECE WRISTBAND WITH INTERCHANGEABLE BAND ELEMENT FOR USER SELECTABLE SIZING

BACKGROUND

1. Field of the Description

The present description relates, in general, to wearable bands such as wristbands that are adjustable in size, and, more particularly, to wearable band assemblies that include a multi-sizing mechanism provided by a two-piece band design, e.g., including a band element that mates with a base (or identification) band element via sliding and/or snapping engagement, that allows the wearable band to be sized in a tool-less manner by a user or wearer.

2. Relevant Background

Bands such as wristbands are worn in numerous settings. For example, watches have typically been worn on a wrist through the use of a wristband. In hospitals, patients often are provided an identification bracelet, strap, or band that they wear on their wrist. An amusement or theme park may provide a visitor or guest with a wristband that includes identification information or technology (e.g., a readable bar code, a radio frequency identification (RFID) transceiver or module, or the like) that identifies the visitor and allows the visitor to access the park's facilities. Often, bands are worn as fashion accessories or to allow the wearer to make a statement (e.g., to support a cause such as medical research, a political candidate, a sports team, or the like). It is likely that the demand for wearable bands such as wristbands will continue to grow in the coming years.

One ongoing challenge for the makers of wristbands and other wearable bands is providing proper sizing for the end users. For example, most multi-size wristwatches include a first band portion that is attached at a first end to the timepiece and at a second end may have a number of spaced apart holes. A second band portion is attached at its first end to the timepiece and at its second end may contain a buckle-style clasp mechanism for mating with the holes of the first band portion. A person uses the clasp mechanism to both size the band about their wrist and to also lock the timepiece to their wrist. The wristwatches are multi-size in that the spaced apart holes allow the same wristwatch to be worn by a set of people whose wrists have a size that falls within a predefined range (e.g., a minimum and maximum sized wrist diameter defined by the first and last hole on the band).

However, people outside this predefined range would not be able to wear the wristwatch, and the wristwatch manufacturer either simply loses these sales or may provide additional wristwatches that have different size ranges to suit these other buyers. Unfortunately, this requires added inventory that may or may not be sold. Some efforts have been made to provide band designs that allow the band to be sized for a particular person, but these designs typically require specialized tools to adjust the band and are expensive to manufacture. In other cases, a band selected for a user to match their wrist size may be attached to the timepiece, but, again, this typically requires a special tool for attachment of the band to the timepiece and may require the buyer to have the watch sized by a trained technician.

As another example of the use of wearable bands, RFID wristbands are commonly used in hospitals and entertainment venues to identify individual patients and guests. The wristband may include or provide a link to a variety of information such as the person's name, their room number, a seating location for a show, entitlements permitted in the hospital or venue, and so on. The wristband is often designed to be secured or locked onto the wrist of the person during their stay at the hospital or participation in an entertainment event.

While these wristbands have been useful in identifying the patients and guests, their design has typically not effectively accommodated the wide range of users' wrist sizes, which has resulted in many users having very loose or too tight and uncomfortable fitting wristbands. Additionally, many wristband designs use either an adhesive closure that is peeled away from the wristband or a separate, one-time plastic snap closure. The adhesive closures sometimes do not provide the closing strength desired and once removed, cannot be worn again. The plastic snap closures provide greater closing strength but often are intentionally designed for one time use, which limits use of these bands on an ongoing or repeated basis. Further, the snap closures often do not support a large enough range of wrist sizes such that they are often too tight or cannot be worn comfortably or are too loose which may allow them to fall off.

Accordingly, there remains a need for a low cost, multi-sizing mechanism for RFID wristbands and other wearable bands or straps. The band designs preferably would have durable opening and closing features to allow reuse of the band and would support relatively inexpensive manufacture from a variety of available materials such as plastics, silicones, metals, leathers, cloths, and/or other materials used presently (and in the future) for wearable bands. Further, there is a need for such a multi-sizing mechanism to be more fully adjustable to the wearer's wrist size, to provide a secure fastening mechanism that during regular wear can be fastened and unfastened by the wearer with ease, and to provide an aesthetic appearance that accommodates different wrist sizes within a large audience or wearer demographic.

SUMMARY

To address the above and other problems with wearable bands such as identification bands, a wearable band design is provided that allows a wearer to easily adjust the size of the band to suit the size of their wrist (or other body part such as the ankle or neck) through the use of a personalization band element or extending/sizing band element that is interconnected or coupled to a base or identification band element (e.g., a one-size band element that may include identification technology such as RFID tag or module).

The sizing band element may include a tapered post or rib along one end that mates with a similarly sized/shaped groove or slot provided on one end of the base or identification band element, and one or more raised surfaces may be provided to allow the sizing element to snap or lock into its connection with the base band element as these raised surfaces mate with corresponding recessed surfaces on the base band element. In other embodiments, the coupling/interlocking is provided by reversing which of the band elements has which portion of the tongue and groove mechanism (e.g., the sizing band element may have the groove/slot while the base band element may have the tongue or rib extending from its end). Sizing is achieved by selecting a sizing band element of a proper length such that the combined length of the sizing band element and the base band element match the intended wearer's wrist size (or neck, ankle, or wearing location dimensions).

It was recognized that prior techniques of providing multi-size wristbands and similar products seemed to either require large inventories or provided a disposable wristband that provided no ongoing revenue source (or source of additional product sales). The wearable band assemblies described herein provide a product platform in that they typically include a base portion (e.g., a band element with an RFID or other information technology component) and an interchangeable extending or sizing portion (e.g., a sizing band element providing half of the interlocking fastening mechanism) that may be sized by the user and readily attached and detached from the base portion (which provides the other half of the interlocking fastening mechanism). In this manner, the wristband assembly permits interchangeability with a wide range of wearable styles of merchandise product offerings as the sizing band element may be sold or distributed separately from the base portion so as to allow a user/wearer to later purchase differing sizing band elements to personalize or modify their wristband or wearable band assembly. The base or identification band element, though, may be provided in a single (or limited number) of designs to simplify its design and reduce cost of its manufacture and distribution (or reduce inventory costs as only one to several choices may be provided). The wearable band assembly may also be adapted to include wearable charms that slide over and are retained by the sizing band element (or over the base band element in some embodiments), which further allows the wearable band assembly to be personalized to suit an individual wearer.

In some cases, a band assembly is provided that allows an RFID or other identification module to be worn by end users that may have a wrist size falling within a relatively large range (or within two, three, or more wrist size ranges). The band assembly may be considered a two-piece design in that it includes: (a) a base or ID band element with a body that includes a user identification member such as an RFID tag or module at or within one end; and (b) a sizing or extending band element with a body that includes a portion of an interlocking fastening mechanism at one end to attach to a corresponding portion of the interlocking fastening mechanism provided in an end of the base or ID band element (e.g., a groove provided at the end containing the user identification member when the sizing element includes a rib or post (or tongue)). The two interlocking bands cover or are useful for wearing by users having wrists falling within a defined wristband size range.

More particularly, a wearable band assembly is provided that may be used by a wearer to fit their wrist size properly (e.g., by selecting a sizing band element with a desired length and assembling the band assembly without use of tools). The assembly includes a base band element with a body extending from a first end to a second end, and the second end may have a thicker and/or wider portion (or head) that contains an RFID or other ID technology module and/or include a timepiece. The assembly also includes a sizing band element with a body extending from a first to a second end. The band assembly includes an interlocking fastener that slidably (or with a sliding manner) engages or couples the base band element to the sizing band element so as to define a one-piece band with a desired length/size.

The interlocking fastener may include a first portion provided on the second end of the base band element body and a second portion on the second end of the sizing band element body. In one embodiment, the fastener is provided as a tongue and groove mechanism, and, in this case, the first portion may be a tongue member extending from the base band element body and the second portion may be a groove or slot in the end or edge of the sizing band element body. The tongue member may have a body with a circular cross sectional shape, and this body may be positioned such that it extends transverse to a longitudinal axis of the base band element body (e.g., be cylindrical with a uniform or tapering diameter from a first to a second end and positioned to extend along the edge or end of the band body). To provide a locking or snapping engagement, the tongue member may include a raised surface or ridge extending about its periphery (such as near an end of the body) and the groove may include a corresponding (corresponding in size/depth, shape, and location) recessed surface for receiving the raised surface when the tongue member is inserted into the groove to couple the sizing and base band elements together.

In some embodiments, the base band element may include a user identification member or module such as an RFID tag or the like that stores information pertaining to a wearer of the band assembly. In some cases, the user identification module is provided within the second end (e.g., in a thicker and/or wider portion of the base band element body). The band assembly may also include one or more charms that may be provided on either band element. In some embodiments, a charm is provided with a hollow or tubular body with a sidewall defining a chamber with a cross sectional shape chosen to allow the charm to slide over the body of the sizing band element (e.g., with tapered sidewalls suiting or matching a tapered portion of the sizing band element body so as to place the charm proximate to the second end or near the interlocking fastener).

DETAILED DESCRIPTION OF THE PREFERRED EMBODIMENTS

The following description is generally directed toward a wearable band such as a wristband that may be readily configured to one of two or more sizes (overall band lengths) by selecting and interchanging sizing band elements. The attached figures illustrate several embodiments of such a wearable band, but, prior to describing these band embodiments, it may be useful to more generally describe exemplary wearable bands (which may also be called wristbands herein for simplicity of explanation without being limited to use on a wrist) and advantages of such bands when compared with existing bands or straps. Additionally, the following description highlights use of the bands as RFID wristbands, but it will be understood based on the description that the bands can readily be used with nearly any identification technology (such as barcodes or the like) as well as for bands without identification technologies/readable information. For example, the bands may be used with timepieces/watches or as products worn for fashion or other reasons.

Generally, the wearable bands described herein are designed to address or solve the multi-sizing and fastening mechanism problem that faces makers of wrist and other bands. The bands are easy for end users to assemble or configure into a particular size and allow interchanging of sizing or personalization band elements to personalize the bands. The bands are also adapted to make manufacture relatively inexpensive as its two-piece design provides a base band component or element (e.g., a band piece (or half of a wristband) that contains the identification module such as RFID tag or module) and a band sizing element. The base band element and the band sizing assembly are coupled together and function together to provide a multi-size band that can be used by all or a large portion of the population. The supply chain is also simplified in this manner as one or several base designs may be offered to the consumers, who can optionally personalize their bands by purchasing personalized/customized portions of the band (e.g., replacing all or portions of the band sizing assembly such as replacing the band sizing element and/or adding decorative charms onto the sizing band element).

Figure 2:
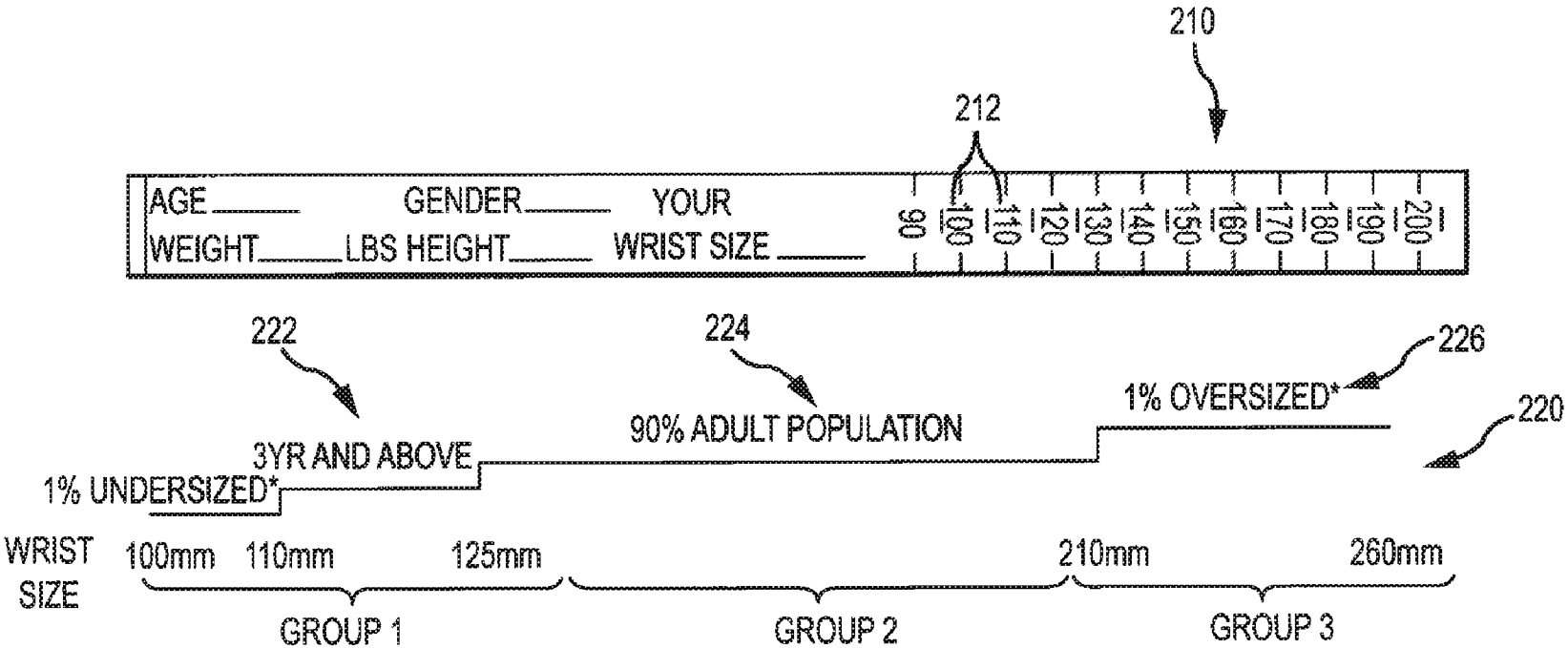
FIG. 2 illustrates a tape measure or tool that may be used by a purchaser/wearer of a band assembly to size their wrist and further illustrates a graph showing grouping of wrist sizes or ranges of wrist sizes to correspond to lengths/sizes of a band assembly (such as the assembly of FIG. 1) via inclusion of a particular band sizing element (or personalization band element" or "extension")
Figure 3:
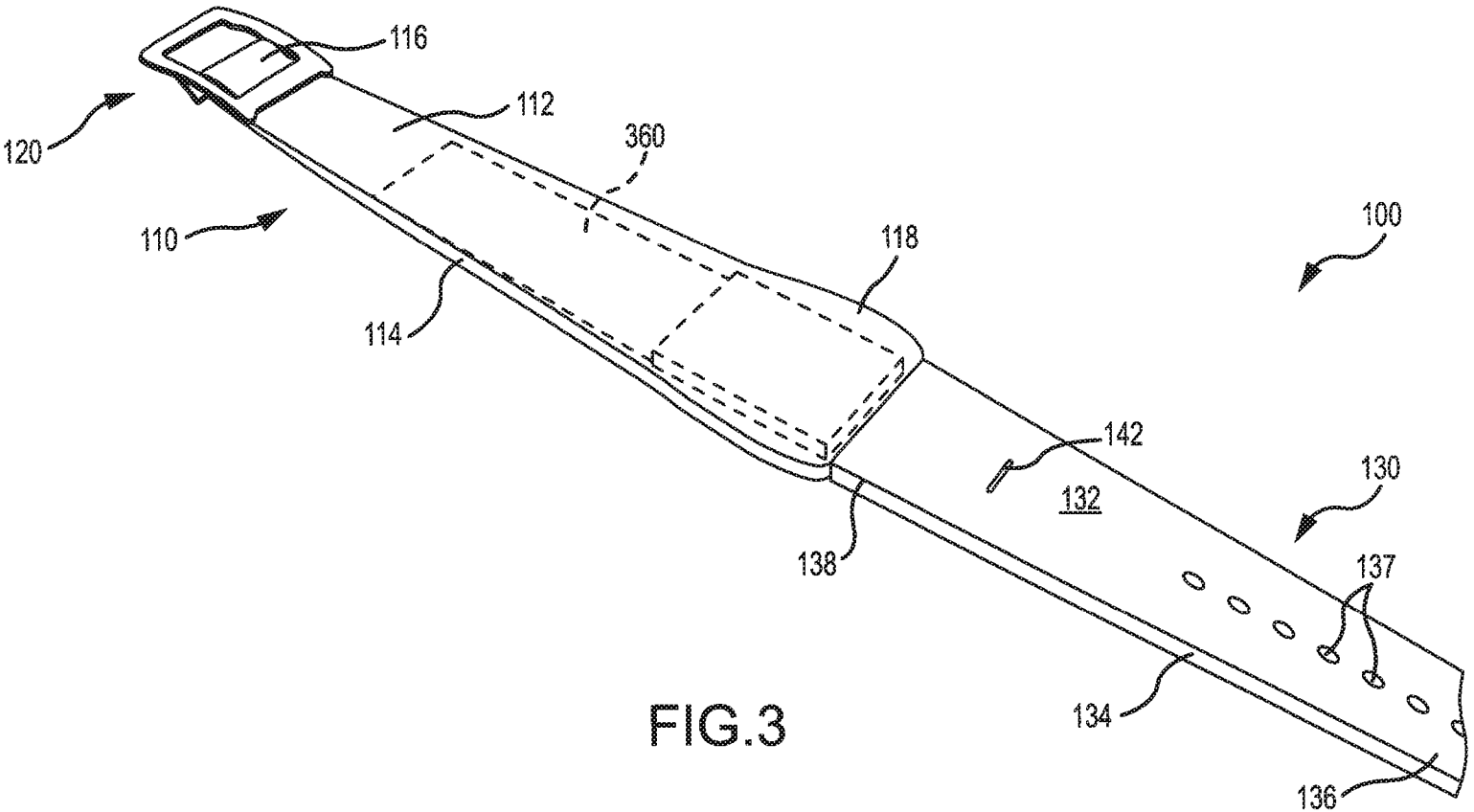
FIG. 3 illustrates the wearable band assembly of FIG. 1 showing inclusion of ID technology within the base band element and also showing the assembly without a charm.

In one example, an adjustable RFID wristband is provided that can be manufactured from a variety of modern day materials including plastics, rubbers, and silicones and even, in some cases, metals, leathers, cloths/textiles, and other materials. The wristband is fully adjustable by the wearer to suit their wrist size and also provides an aesthetic appearance. The wristband is also adapted to provide a secure wristband fastening mechanism that during regular wear can be fastened and unfastened by the wearer with exceptional ease (e.g., the band supports reuse rather than being a one-time product as was the case with many prior one-size-fits-all straps). This embodiment may be thought of as providing a band assembly made up of a two-piece band design including a base or identification band element and a band sizing element, with the interchangeable band sizing element being selected from a set of such sizing elements to have a desired length to allow the wristband to cover or be used with a defined wristband size range or wrist size range (see FIGS. 2 and 3 showing exemplary sizing groups and an assembled wristband that may be worn on a user's wrist). For example, the band may be sold or provided to a user with a set of sizing band elements, and the user may select a small, medium, or large sizing element to suit their particular wrist size and then assemble the band by coupling the base band element and a selected one of the sizing band elements together.

The interconnecting or coupling mechanism may be provided in a number of manners. In some embodiments, the base band includes a rib or tongue extending out from an end of its body while the sizing band element includes a groove or slot on an end of its body. To assemble the two band components, the rib/tongue may be slid into the groove or slot. The inner and outer diameters of the groove and rib as well as their cross sectional shapes are selected to facilitate mating (e.g., the same or similar diameters with a circular cross section or the like). In some cases, the slot/groove and rib may be tapered with a decreasing and increasing diameter, respectively, to provide a desired coupling with a built in stop (e.g., the rib/tongue will not pass through the slot or groove and can only be inserted at one direction).

To provide a more secure coupling or locking of the band elements, the rib/tongue may include one or more raised surfaces or bands extending about it perimeter (such as near the top and/or bottom of the rib/tongue) while the groove/slot includes a corresponding or matching recessed surface for receiving this raised surface or band (or this locking/snapping may be reversed with the raised surface provided on the groove or slot and the recessed/receiving surface provided on the rib/tongue). In this manner, which may be used with uniform or tapered diameter ribs/grooves, the band elements can be securely coupled together such that some amount of force has to be applied to disengage the band elements (e.g., to replace the sizing band element with a different element having a differing size and/or differing graphic or other design).

Prior to the band designs presented herein, many wristbands used either an adhesive closure that is peeled away from the wristband or a separate, one-time plastic snap closure. The adhesive closures sometimes did not provide a desired closing strength and once removed could not be worn again. The plastic snaps provided a greater closing strength but were also often designed for one-time use, did not fit the wearer comfortably, and/or were too loose. With regard to other band applications, a typical wristwatch incorporates a buckle-style watch clasp. Similar to shoe manufacturing, most wristwatches are designed with a particular style with that same style or product run having a variety of wristwatch bands in different sizes to accommodate the specific end users' wrist sizes. However, similar to shoe shopping, when an end user purchases a wristwatch they try on different sizes of wristwatches (or wristwatch bands) of the same style to determine which band fits them appropriately. Because of the variability of different end user wrist sizes, the watch retailer must keep a large inventory of different wristband sizes to accommodate their customers, which significantly increases inventory costs for the retailer that may be acceptable in some settings (such as for higher end band products such as certain wristwatches).

However, in many fashion and wearer ID settings (such as entertainment venues and the like), it is much more desirable to be able to provide a one-size-fits-all solution or band design that can be sized by the seller or the wearer to suit their wrist size rather than carrying numerous versions/sizes of the band. The described wearable bands provide a "one size fits all"

design that provides at least two and sometimes three or more wearable and user-selectable/interchangeable band sizing elements (e.g., the product or extension portion of the two-piece band design), with the sizing band element being attachable to the base band element via tongue and groove coupling or other interlocking mechanism provided via coupling components at an end of each of the band elements. This configuration allows a venue operator or provider of bands to maintain one common base band (e.g., the intelligence or ID portion of the two-piece band) inventory and one or more sizing band elements that together accommodate a wide range of wrist sizes (e.g., address the multi-sizing problem associated with serving large audience/customer bases).

Figure 1:
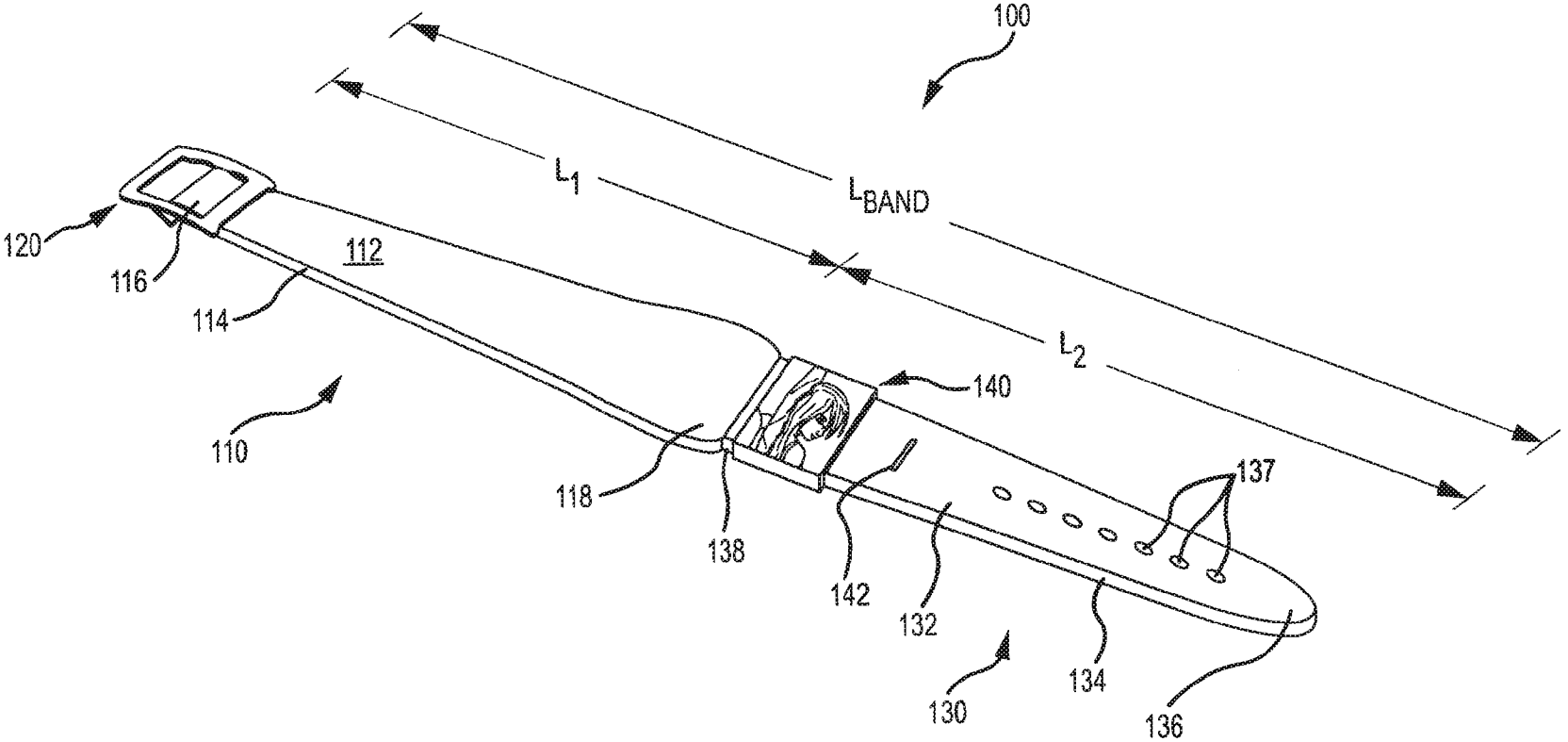
FIG. 1 is a top perspective view of a wearable band assembly of an embodiment of this description as may be delivered or provided to a purchaser or wearer (e.g., assembled to have a band length such to suit a group or range of wrist sizes with the range defined by the sizing band element selected for the band assembly and the range defined by the clasp holes in the sizing band element)

FIG. 1 illustrates one embodiment of a wearable band assembly 100 that may be used to provide a single band product that can be worn or used by people (i.e., wearers or users) with wrist sizes that fall within one of two, three, or more predefined size groups. The band assembly 100 may be thought of as providing a two-piece band design that includes a base band or base band element 110 and a band sizing element or sizing band element 130. The band assembly 100 also includes a buckle-type clasp 120 for fastening the interconnected or coupled band element 110 and sizing assembly 130 to a wearer's wrist by connection via holes 137 in sizing band element 130. The wearer may simply select a combination of a base band element 110 with a first length, $L_1$, and a sizing band element 130 with a second length, $L_2$, to define an overall band length, $L_{Band}$ (which may then be used over a range of wrist sizes by selection of one of the holes 137 with clasp 120) and to size the band assembly 100 to fit their wrist.

Figure 4:
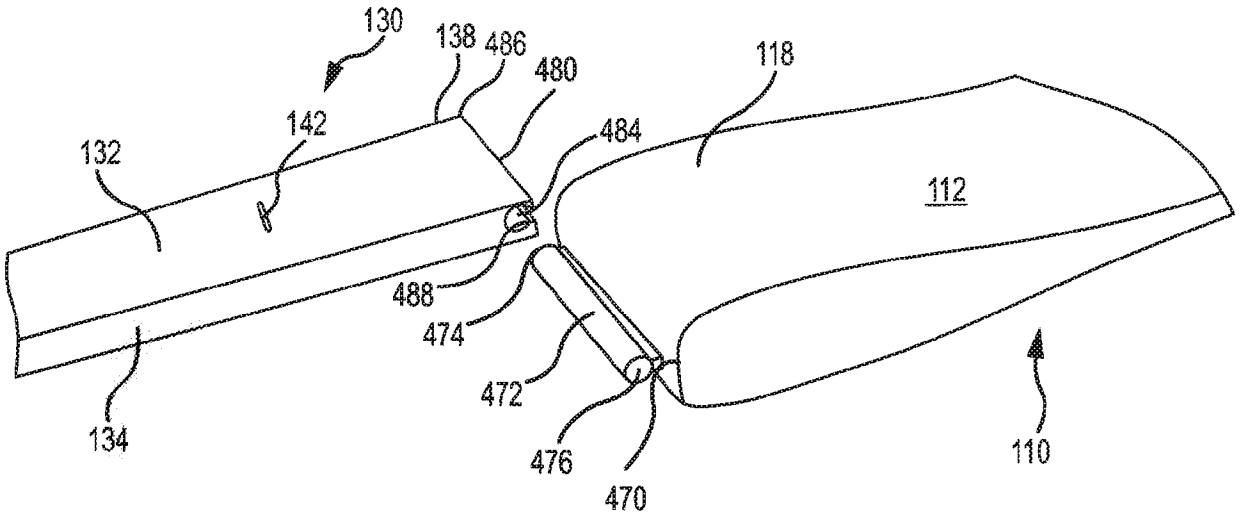
FIGS. 4 and 5 illustrate the interlocking or coupling mechanisms of the wearable band assembly with FIG. 4 showing the two band elements in a disassembled arrangement and FIG. 5 showing the two band elements during initial engagement (or in partial decoupling or removal of the sizing band element from the base band element)

The band element 110 may be thought of as the base or, in some cases, intelligence (or ID) band or component as this element 110 is included in each configuration of the band assembly 100. The base band 110 has a body 112 that extends from a first end 116 to a second end 118 where it is connected to or where it includes a head (or, in many embodiments, a user identification member/module) and includes a coupling component (such as a groove/slot) for mating with a coupling component provided on the end 138 of sizing band element 130. The shape of the body 112 is defined by an outer edge or sidewall 114 that extends about the periphery of the body 112, and, as shown, the body 112 may be generally rectangular with a rounded or circular end 116 and head at end 118 that may be thicker and wider (e.g., to receive or hold a watch or ID module or the like). The head/user identification member at end 118 of the body 112 also includes a portion of a coupling or interconnecting mechanism (such as shown in FIGS. 3 and 4 or other configuration useful for connecting two bands or band elements 110, 130 of the assembly 100) used to connect or lock the base band element 110 to adjacent/overlapping sizing band element 130 (e.g., the band elements 110, 130 may be press fit together to provide interchangeable coupling).

As explained with reference to FIG. 3, the base band 110 also may include an identification technology portion in the head or in the end 118 of the body 112. For example, the band assembly 100 may be adapted for identifying the wearer such as by the inclusion of an RFID transceiver or RFID element embedded within the ID technology portion (or user identification member) in or on the body 112 such as near the end 118 or elsewhere within or on the body 112.

The band assembly 100 also includes a second piece in the form of a sizing band element 130 that can be selectively coupled to the edge/end 118 of the body 112 of base band element 110 as part of sizing or personalizing the band assembly 100. As shown, the band sizing element 130 includes a body 132 that extends from a first end 136 (which may have holes 137 for receiving/mating with clasp or buckle 120) to a second end 138. As is explained below, the body 132 includes coupling component at the end 138 (e.g., a rib extending from the edge or sidewall 134) that allows it to be selectively coupled to the body 112 at end 118. A user may choose a sizing element 130 at least partially based upon its length, $L_2$, so as to define the overall length, $L_{Band}$, of the assembly 100 so as to provide a user adjustable or sized assembly 100. The shape of the body 132 is defined in part by the outer sidewall or edge 134 that extends about the periphery of the band element 130. The body 132 may be generally rectangular in its outer shape with rounded end 136 as defined by the outer edge or sidewall 134. Also, the body 132 of the sizing band element 130 may include a number of holes 137 in or near end 136 such that the clasp 120 (with a clasp prong or pivotal engaging member) may be engaged with the sizing band element 130.

The band assembly 100 may include a charm 140 that may be mounted onto the body 132 of the sizing band element 130. As shown, for example, the charm 140 has a body that is hollow or includes a chamber for receiving the body 132 so as to allow the charm 140 to be slid onto the body 132. More specifically, the chamber of the body of the charm 140 may have a cross sectional shape and size that matches that of the body 132 near the end 138 (e.g., rectangular with or without tapered sidewalls extending from a lead to a trailing edge). A ridge 142 may be provided on the outer surface of the body 132 (such as on the upper surface as shown in FIG. 1) to retain the charm 140 in place on the band body 132, and, in this regard, a knob or similar structural component may extend out from the top wall of the charm 140 to catch on the ridge 142 to provide a friction/contact-based retention of the charm 140 within the assembly 100.

The bodies 112, 132 may be formed of the same or differing materials, and these materials may vary to implement the assembly 100. In some embodiments, the bodies 112, 132 are formed of a plastic, a rubber (e.g., a silicone or the like), or similar material that may be relatively rigid but still be comfortable to wear and also be flexible to facilitate coupling of the two band elements 110, 130 at the mating points between walls 114, 134 near ends 118, 138 of band elements 110, 130. The number of holes 137 may also be varied widely to practice the assembly 100 as well as the spacing between adjacent ones of the holes. Generally, one to three or more holes will be provided on the end 136 such that the clasp or buckle 120 may engage with the holes 137 to allow connection of the two ends 116, 136 of a particular arrangement of assembly 130 and band 110 and to allow the band assembly 100 to be sized for a range of wrist sizes in each of its two or more configurations. In other words, the band element 130 provides or supports a range of sizes with its holes 137 for a particular band length, $L_{Band}$, while the selection of the particular sizing band element 130 and its length, $L_2$ (when combined with base band element length, $L_1$) defines the size range or length, $L_{Band}$, of band 100.

FIG. 2 illustrates a tape measure 210 that may be used by a wearer to determine or measure their wrist size. The tape measure 210 includes markings 212 that indicate the measured size when the tape measure 210 is wrapped about the wrist and aligned with the end of the tape measure 210. As shown, in a human population, the smallest wrist size is typically about 90 millimeters (mm) while the largest wrist size is over 200 mm (such as about 260 mm or more). In one embodiment, the band assembly 100 may be provided or shipped with the tape measure 210, and the user/wearer may use the tape measure to determine their wrist size. This wrist size may then be used to determine which of two or more sizing band elements 130 to choose to obtain a band length, $L_{Band}$, that covers, or is useful by a wearer with, their wrist size (e.g., small, medium, or large band element 130 or the like associated with the various wrist size groups).

In this regard, graph 220 illustrates exemplary groups 222, 224, 226 that may be provided for a band assembly 100 for a typical human population. In this example, the band assembly 100 is a wristband and graph 220 represents differing wrist sizes for which it is desirable to provide a multi-sizing band assembly 100. As shown, a first group 222 that typically includes children and adults with smaller wrists is shown (e.g., wrists of about 100 to 130 mm or the like). In the band assembly 100, the combination of the base band 110 and a first sizing band element 130 (e.g., with a particular smaller length, $L_2$) may be configured to provide an assembly 100 with a length covering this first group. Holes 137 may be used to allow the assembly 100 to be worn by people with wrists falling into the first group 222 (e.g., less than about 130 mm in "diameter").

A second group 224 may be defined or selected to include a range of "average" teens and adults. For example, the second group 224 may range from about 130 mm (or some number smaller to provide overlap with group 222 such as 125 mm) to about 190 mm or the like, and a second band sizing 130 may be included in the sizing assembly 100. In this manner, the combination of the base band 110 and sizing band element 130 may have a length, $L_{Band}$, that is chosen in combination with the arrangement of holes 137 to allow the band assembly 100 with coupled bands 110, 130 to be worn by individuals having a wrist size between 130 and 190 mm (or other lower and upper bounds).

Finally, in this example, a third group 226 may be defined to include people with larger wrists such as wrists of 190 mm to 240 mm (or some other lower and upper bounds with the lower bound often being chosen to provide an overlap of the second and third groups 224, 226 such as 185 mm when the second group upper bound is 190 mm). A third band element 130 may be chosen or used that is designed or chosen to have a larger length, $L_2$, such that the assembly 100 now has a greater length, $L_{Band}$, such that this length when combined with the arrangement of holes 137 allows people with wrist sizes falling in the third group 226 to wear the band assembly 100.

FIG. 3 illustrates one embodiment of a wristband 100 including an RFID module (or other ID technology component) 360 provided within a base band element 110. As shown, the wristband assembly 100 includes the base band element 110 and a sizing band element 130. The two band elements 110, 130 each include a body 112, 132 with an interlocking fastener provided by the configuration of a sidewall 114, 134 at mating ends 118, 138 of the bodies 112, 132 (which is shown and explained more with reference to FIGS. 4 and 5 below). The RFID module 360 may be adapted to store information pertaining to the wearer of the wristband assembly 100 such as identification information and access rights to a facility (such as amusement park or the like), and this ID/user information may be read by an RFID reader (not shown). The RFID module 360 may include an RFID chip/tag positioned in or proximate to the head or end 118.

As also is shown in FIG. 3, the wristband assembly 100 is also adapted for sizing and attachment to a user's wrist. As shown, the end 136 of the sizing band element 130 includes a number of spaced apart holes 137 through the body 132 and on the end 116 of the base band element 110 a buckle 120 is mounted. During use, the buckle 120 may be used to attach the end 116 to the end 136 and to size the wristband assembly 100 by selection of one of the holes 137 (as is common for many wristband designs). Further, FIG. 3 illustrates that the body 132 of the sizing band element 130 may be configured for more securely retaining/positioning a charm 140, and, to this end, a knob or friction ridge 142 may be provided for mating with a knob/ridge extending from an inner surface of the sidewall (top wall) of the charm 140 (see FIG. 10 for configuration of a charm 140). In this manner, a charm 140 may be slid over the body 132 from the end 136 toward the inner end 138 until the charm 140 passes over the knob/ridge 142, and, then, removal requires application of an amount of force to overcome the friction between the knob/ridge 142 and the sidewall of charm 140.

Figure 5:
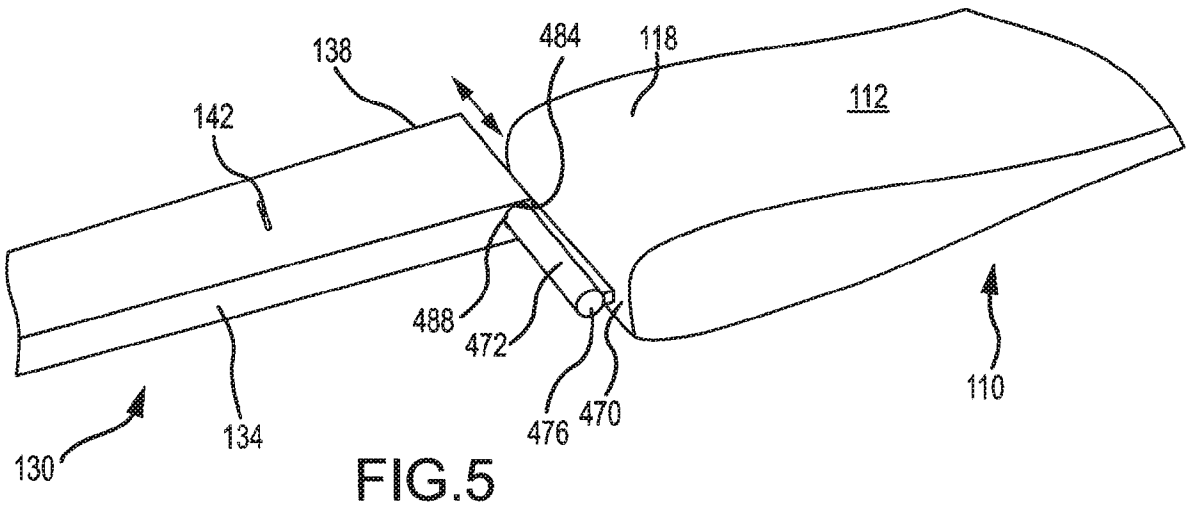

FIGS. 4 and 5 illustrate a partial view of the wristband assembly 100 showing one embodiment of the interlocking fastener mechanism that may be used to allow the band elements 110, 130 to be selectively connected and then later disconnected by a user in a toolless manner. As discussed above, the user/wearer may choose a sizing band element 130 with a particular length, $L_2$, to define the overall length, $L_{Band}$, of the band assembly 100, and then attach this chosen band element 130 to the base band element 110. In other cases, the user/wearer may wish to replace a sizing band element 130 with a different band element 130 (with differing colors, graphical treatments, and so on) to personalize the assembly 100 or to change the look of the assembly 100.

As shown, the band elements 110, 130 may each be thought of as containing a portion of interlocking fastener, with FIGS. 4 and 5 showing a tongue and groove or mechanism facilitating sliding engagement between the ends 118, 138 of the bodies 112, 132. Specifically, the endwall or edge 470 of base band element 110 includes a tongue or rib 472 that extends outward from the end 118. The tongue 472 may extend a length from a first end 474 to a second end 476, and the tongue 472 may extend generally transverse or even perpendicular to a longitudinal axis of the body 112 of the base band element 110. The tongue 472 may have a variety of cross sectional shapes with circular being useful in some cases and shown in FIGS. 4 and 5. In some embodiments, the diameter of this circular cross section of the rib 472 is uniform along the length from end 474 to end 476 such that the tongue 472 is generally cylindrical in shape, while in other cases the diameter may increase from end 474 to 476 (to provide a tapered tongue/rib 472).

The endwall or edge 480 of the sizing band element 130 includes a groove or slot 484 corresponding in size and cross sectional shape to the tongue or rib 472. This allows, as shown, the tongue/rib 472 to be inserted into (and removed from) the groove/slot 484 so as to couple the band elements 110, 130 together via their mating ends 118, 138. In this embodiment, the slot 484 may be circular in its cross sectional shape and be uniform in diameter from end 486 to end 488, with end 488 at least being open to receive the end 474 of tongue/rib 472. In some cases, the body 112 may be formed of an elastic material such as a plastic or rubber, and the inner diameter of the groove 484 may be the same or slightly smaller than the outer diameter of the tongue/rib 472 such that a press or interference/friction fit is obtained when the band elements 110, 130 are pressed or forced together as shown in FIGS. 3 and 5. Of course, the location of the tongue and groove components may be reversed (e.g., the tongue provided on the sizing band element 130 and the groove on the base band element 110 rather than as shown in FIGS. 4 and 5).

Figure 6:
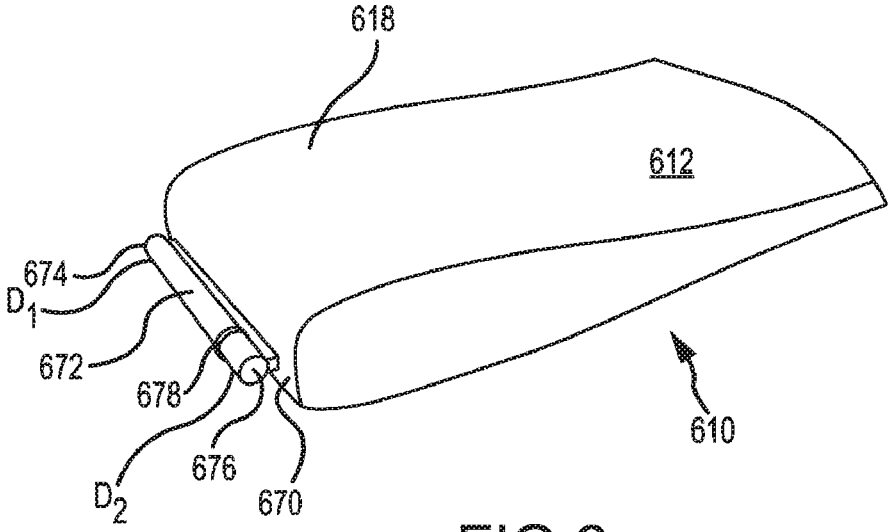
FIG. 6 illustrates another embodiment of a base band element showing a tapered rib/tongue on the end of the body that couples with the sizing band element and the tapered rib/tongue may also have one or more raised surfaces that can be received by a corresponding recessed surface in the slot/groove on the end of the body of the sizing band element to lock the band pieces or halves together.

In some cases, it may be desirable to configure the band interlocking fastener such that the band bodies are "locked" together, with "locked" meaning generally that some predefined amount or magnitude of force has to be applied to separate the two band bodies (e.g., more than mere surfaceto-surface friction as may be the case in the embodiment of FIGS. 4 and 5). For example, FIG. 6 shows a base band element 610 with a body 612 of similar design as body 112 extending from a first end (not shown that may include a buckle/clasp) to the end 618 (which may house an RFID module or other ID technology). The base band element 610 differs in its configuration of the edge or endwall 670 when compared with endwall 470.

The endwall 670 provides a portion of the interlocking fastener in that it provides a tongue/rib 672 that extends outward from edge 670. The rib 672 is tapered from a first (or initial engagement) end 674 to a second end 676 because it has a cross sectional size that increases along its length between these ends 674, 676. For example, the rib 672 may be circular in cross sectional shape with a first diameter, $D_1$, at first end 674 that is smaller than a second diameter, $D_2$, at second end 676. The receiving slot (not shown) in a corresponding sizing band element would have a similarly tapered cross sectional shape/size to receive the tapered rib 672. The use of the tapering cross section in rib 672 also acts to prevent the rib 672 from sliding completely through the receiving groove of the sizing band element, e.g., acts as a built in stop for properly positioning the two band elements relative to each other when coupled/interlocked.

To provide a snap fit or lock, the rib 672 may include one or more raised surfaces 678 at or near the end 676. The raised surface 678 may extend partially or completely about the periphery of the rib 672, and the raised surface or engagement ridge 678 may have a relatively small thickness and height but provide adequate surface area to engage a corresponding recessed surface in toward a second end groove in a sizing band element. In this manner, when the tongue/rib 672 is inserted into a tapered groove of a sizing band element, the sidewalls of the tongue 672 and groove mate and further the ridge/raised surface 678 provides further resistance/friction until it snaps into the recessed surface of the groove (e.g., locks the two band elements together). Then, to decouple the band elements, a predefined amount of force would have to be applied to overcome the friction provided by the raised surface 678 contacting the recessed surface as well as friction between outer surfaces of the tongue 672 and inner surfaces of the groove (which are both tapered in a similar fashion).

Figure 7:
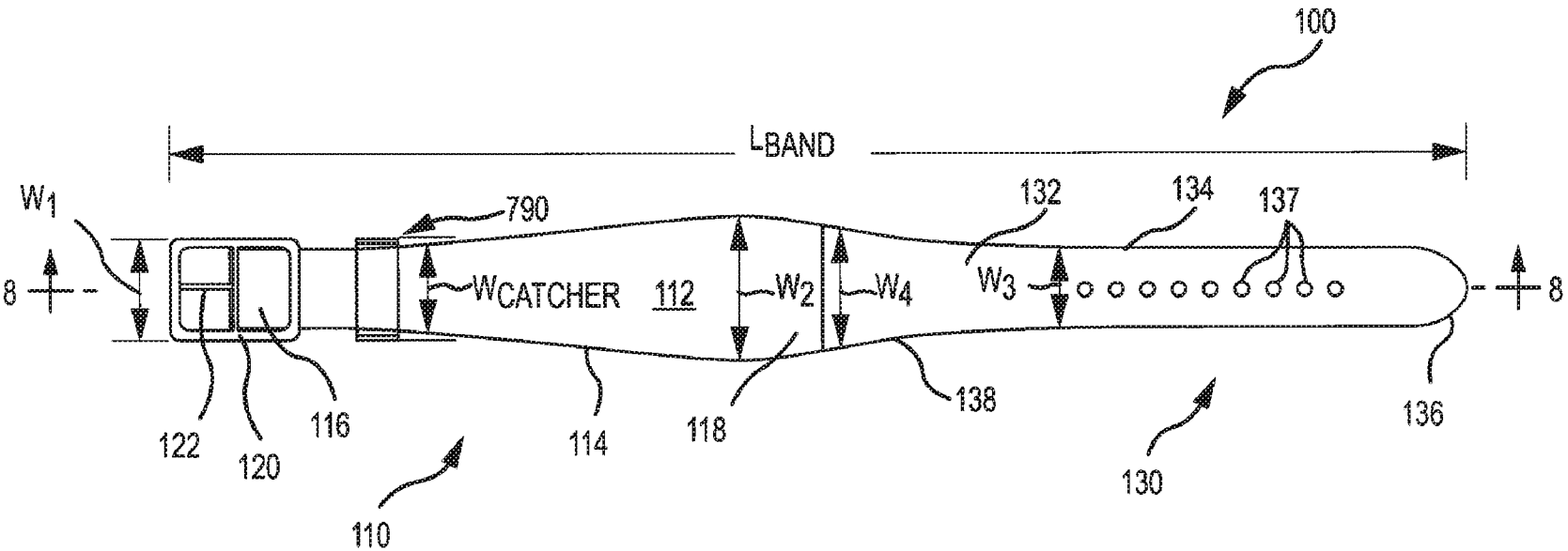
FIG. 7 illustrates a top view of the wearable band assembly of FIG. 1 (without a charm) showing more details of the assembly including the buckle and use of a strap catcher.

FIG. 7 illustrates a top View of the assembled wristband assembly 100 providing additional detail of one embodiment or configuration of the assembly and its band elements 110, 130. As shown, the band assembly 100 may take on a design similar to a conventional wristwatch with the base band element 110 having a body 112 with a shape defined by outer sidewall 114 that has a narrower width, $W_1$, near the first or outer end 116 and a larger width, $W_2$, near the second end or head 118. For example, the first width, $W_1$, may be in the range of 10 to 20 mm while the second width, $W_2$, may be in the range of about 20 to 30 mm. The wider head or end 118 allows for the end 118 to house a time piece or piece of jewelry/decoration and/or to house within the body 112 a RFID or ID module such as module 884 shown in FIG. 8. The length, $L_{Band}$, of the wristband assembly 100 is defined by the combined lengths of the base band element 110 and the sizing band element 130 (e.g., as measured end 116 to end 136 when the elements 110, 130 are coupled/interconnected as shown in FIG. 7).

FIG. 7 also illustrates additional detail for the buckle 120 showing the inclusion of a prong or clasp member 122 that is used to engage a hole 137 to clasp the assembly 100 to a wrist and size the assembly 100 within a particular range (with the range set by which sizing band element 130 is chosen for the assembly 100). Also, in some a configuration, the assembly 100 includes a strap catcher 790 to hold the strap/band 130 and that may be free to slide upon the body 112, at least until the body 112 has a width matching or exceeding the catcher width, $W_{Catcher}$. The body 132 of the sizing band element 130 may also taper from a width, $W_3$, near the outer or first end 136 to a larger width, $W_4$, at the inner or second end 138 (e.g., a width matching or approximating the width of the end 118 at the mating or coupling endwall).

Figure 8A:
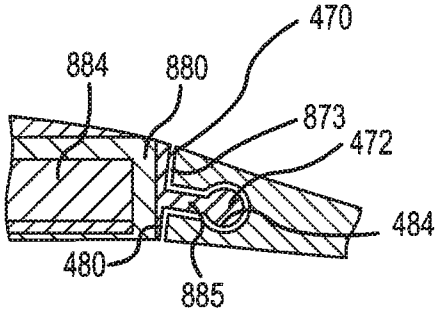
FIG. 8 illustrates a sectional view of the wearable band assembly of FIG. 7 taken along line 8-8 showing an ID module in the base band element head or end and showing an exploded view of the coupling mechanism provided by the sidewall design of the ends of the two band elements (e.g., a sliding or tongue and groove arrangement)
Figure 8:
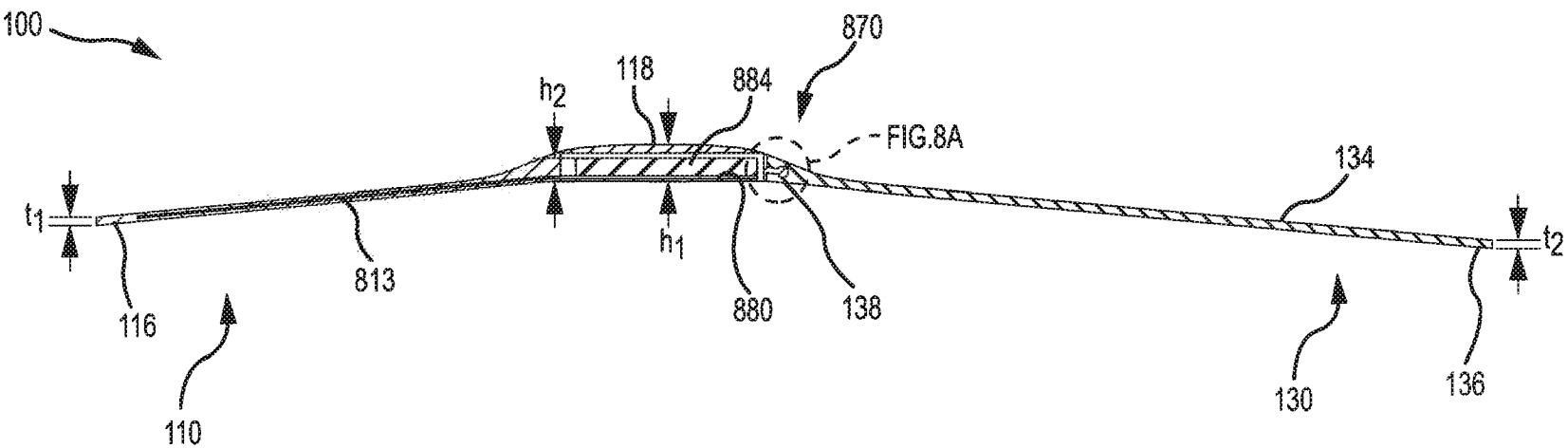

FIG. 8 illustrates a sectional view of the band assembly 100. The assembly 100 as shown includes a chamber 880 in the end/head 118 of the base band element body 112. Within the chamber 880, an RFID module or other ID technology component 884 may be positioned, and, in this regard, the chamber 880 may have a height, $h_1$, that is the same or some small amount larger than the height, $h_2$, of the RFID module 884 (e.g., 5 to 10 mm for the chamber and 3 to 5 or more mm for the RFID module). The base band body 112 may have a relatively small thickness, $t_1$ (e.g., less than about 2 mm) and this may match the thickness, $t_2$, of the sizing band element body 132. The body 112 of the base band element 110 may also include a stiffener 813 extending at least partially from beneath the chamber 880 toward the outer or first end 116, and the stiffener 813 allows softer materials to be placed adjacent the wearer's skin and in interlocking fastener components while still at least partially defining a desired shape for the assembly 100.

FIG. 8 also provides an enlarged view of an exemplary interlocking fastener assembly 870 that may be used to join the ends 118, 138 of the band elements 110, 130. As shown, the assembly 870 provides a tongue and groove coupling or an interlocking device that facilitates sliding or slidable engagement. In this embodiment, the base band element 110 includes the tongue or rib portion as shown at 472, and the tongue 472 has a circular cross sectional shape. The tongue 472 extends outward from the endwall 470 a distance due extension member 885. The sizing band element 130 includes the groove or slot portion of assembly 870 as shown at 484, which also has a circular cross sectional shape for receiving the tongue 472. The groove 484 is open for receiving extension member 885 via channel 873.

Figure 9:
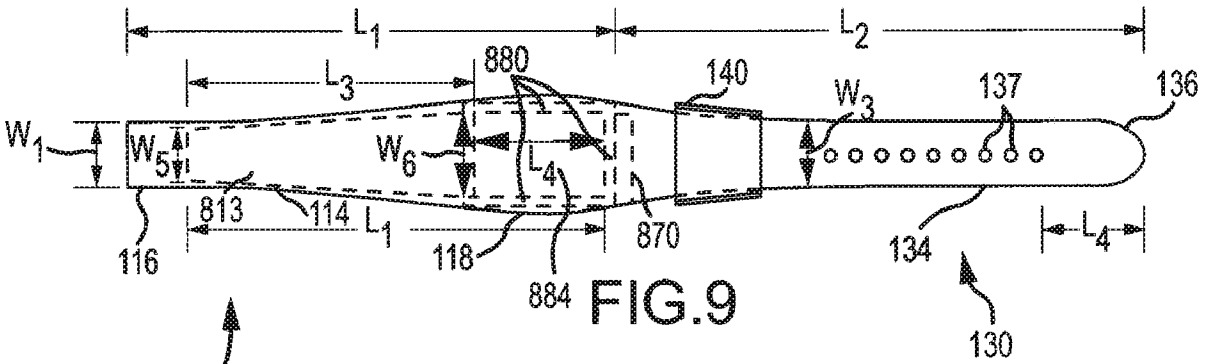
FIG. 9 is a view of the wearable band assembly similar to that of FIG. 7 but also showing the ID module and addition of a charm on the sizing band element body.

FIG. 9 provides further details of the wristband assembly 100 in that it further shows the stiffener 813 and its relative length, $L_3$, relative to the length, $L_1$, of the base band element (e.g., less than about 70 mm when the base band element 110 is about 90 to 120 mm or the like). The stiffener 813 may also be tapered with a first or outer width, $W_5$, that is smaller than the second or inner width, $W_6$ (e.g., some amount less than band widths, $W_1$ and $W_2$). FIG. 9 also shows that the chamber 880 and RFID module 884 may have a width that is about the same as the width, $W_2$, of the head/end 118 and also have a length, $L_4$, that is similar to the head/end 118 (such as 25 to 35 mm or the like). Again, the slide fastener 870 may be a tongue and groove arrangement with a length similar to (or somewhat less than) the width, $W_4$, of the end 138 of the sizing band element 130 (such as 20 to 25 mm or the like). FIG. 9 further shows that the holes 137 may run a length of the body 132 beginning inward some distance, $L_4$, from the end 136 (such as inward about 20 to 30 mm or the like).

Figure 10:
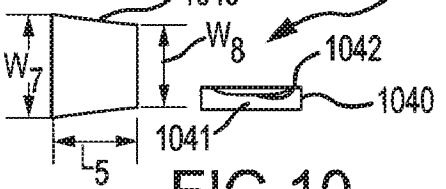
FIG. 10 is an enlarged top and end view of the charm of FIG. 9.

FIG. 9 further shows the assembly 100 including a charm 140 positioned on the body 132 of the sizing band element 130. The charm 140 typically will have a length, $L_5$, (such as 15 to 25 mm) that is less than the gap between an innermost hole 137 and the end 138 such that the charm 140 does not cover any holes 137. As shown in FIG. 10, the charm 140 may have a wall 1040 defining a hollow body with an inner width, $W_7$, that is greater than an outer width, $W_8$ (e.g., 20 to 25 mm versus 15 to 20 mm or the like to suit the tapering width of the band body 132). The sidewall 1040 may define an inner chamber 1041 for receiving the body 132 of the band element 130 and locking or engagement with a ridge or knob on the band body 132 may be provided by inclusion of a ridge or internal nub 1042 on a leading edge of the sidewall 1040 (e.g., a top or upper wall of the charm body) such that the nub 1042 is pushed over the friction ridge on the body 132 to retain the charm 140 from sliding back off the body 132.

Note, the charm(s) 140 may be provided on either band (such as band 110 or 130 in FIG. 1) or on both bands, and the number of charms 140 included is not limiting to the invention. Additionally, some charms 140 may be adapted to include LED or other lighting modules (such as on an upper surface of sidewall 1040 or other useful position), and such lighting modules may be activated in a number of ways such as by an on/off button or switch operable by the user, by motion, or in response to received control signals. In other embodiments, the user ID technology or a portion thereof that is discussed herein may be provided in one or more charms 140 (e.g., a charm sidewall 1040 may be formed to include RFID chip(s) to allow a user to be identified by inclusion of the charm 140). The charm 140 and its user ID technology may be accomplished or performed as described in U.S. Pat. Appl. Publ. No. 12/231,729, titled "Method and System for Performing Affinity Transactions," and assigned to Disney Enterprises, Inc. (the same assignee as this application), which is hereby incorporated by reference in its entirety.

Figure 11:
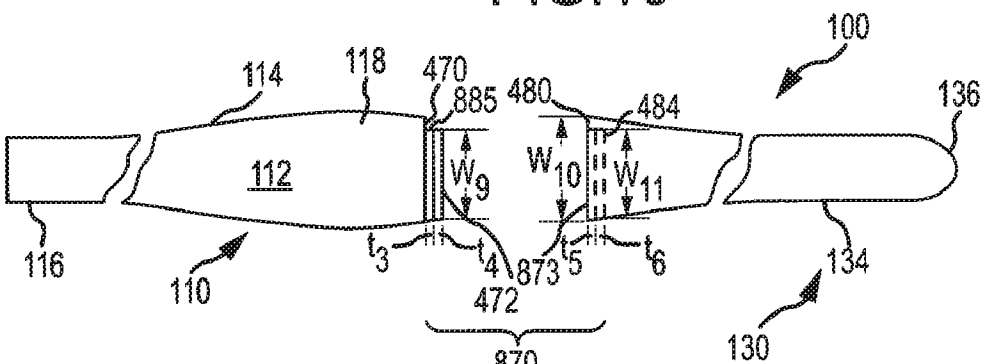
FIG. 11 is an exploded view of the base and sizing band elements showing additional details of the coupling mechanism useful for selectively joining the two elements (e.g., allowing a user to readily size or personalize the assembly by changing out either of the band elements such as the sizing band element).

FIG. 11 provides further details of the wristband assembly 100 with an exploded view or decoupled view of the band elements 110, 130. As shown, the assembly 100 includes a tongue and groove-based fastener assembly 870. This assembly 870 is made up of a tongue 472 on the edge 470 of the body 112 of the base band element 110. An extension member 885 with a thickness, $t_3$, defines the location of the rib or tongue 472, which also has a selected thickness or diameter, $t_4$ (e.g., 1 to 3 mm each or the like). Typically, the tongue 472 does not extend the entire width of the end 118 as shown with width, $W_9$, which does not extend completely across endwall 470 (e.g., may be 1 to several mm less than endwall width). Likewise, the fastener assembly 870 includes the groove 484 provided in endwall 480 of the body 132 of the sizing band element 130, and the location of the groove 434 is defined by channel 873 (e.g., each may have thicknesses, $t_5$ and $t_6$ similar to the thicknesses $t_3$ and $t_4$ to allow the tongue 472 to be received within the groove 484). The width, $W_{11}$, of the groove 484 typically will also be less than the width, $W_{10}$, of the endwall 480 (e.g., 1 to 2 or more mm less) and may match or be just slightly larger than the width, $W_9$, of the tongue member 472 such that the tongue 472 is fully received within the groove 484 (is flush or even recessed along sidewall 134 of the sizing band element 130).

The above described invention including the preferred embodiment and the best mode of the invention known to the inventor at the time of filing is given by illustrative examples only. It will be readily appreciated that many deviations may be made from the specific embodiments disclosed in the specification without departing from the spirit and scope of the invention.

We claim:

1. A wearable band assembly, comprising:

a base band element with a body extending from a first to a second end;

a sizing band element with a body extending from a first to a second end; and an interlocking fastener slidably coupling the base band element to the sizing band element, wherein the interlocking fastener comprises a first portion provided on the second end of the base band element body and a second portion provided on the second end of the sizing band element body, wherein the interlocking fastener comprises a tongue and groove mechanism, wherein the first portion comprises a tongue member extending from the second end of the base band element body and the second portion comprises a groove provided on the second end of the sizing band element body, wherein the tongue member comprises a body with a circular cross sectional shape and wherein the body extends with a longitudinal axis transverse to a longitudinal axis of the base band element body, and wherein the tongue member further comprises a raised surface extending about the periphery of the body of the tongue member and wherein the groove comprises a recessed surface corresponding to the raised surface for receiving the raised surface and retaining the tongue member in the groove.

2. The band assembly of claim 1, wherein the base band element further comprises a user identification member storing information pertaining to a wearer of the band assembly.

3. The band assembly of claim 2, wherein the user identification member comprises a radio frequency identification (RFID) tag.

4. The band assembly of claim 1, further comprising a charm with a hollow body configured for receiving at least a portion of the sizing band element body, whereby the charm is selectively mounted on the sizing band element body proximate the interlocking fastener.

5. An identification band, comprising:

a base band comprising an elongated body including a user identification member; and a sizing band having an elongated body, wherein a tongue member is provided on an end of one of the base band and the sizing band and a groove configured for receiving the tongue member is provided on an end of the other one of the base band and the sizing band, whereby the sizing band is detachably coupled with the base band, wherein the tongue member has a cylindrical body with a longitudinal axis extending transverse to a longitudinal axis of the base band body, wherein the tongue member extends outward from a sidewall of the one of the base band and sizing band, wherein the cylindrical body of the tongue member further comprises a raised surface extending about a periphery of the cylindrical body, and wherein the groove includes a corresponding recessed surface for receiving the raised surface when the tongue member is inserted into the groove to couple the base band to the sizing band.

6. The band of claim 5, wherein the user identification member comprises an RFID device.

7. The band of claim 5, wherein the diameter of the cylindrical body of the tongue member has a first diameter at a first end and a second diameter at a second end that is greater than the first diameter.

8. A wristband, comprising:

a base band element with a body extending from a first to a second end, wherein the base band element further comprises a user identification member storing information pertaining to a wearer of the band assembly and wherein the user identification member comprises a radio frequency identification (RFID) tag;

a sizing band element with a body extending from a first to a second end; and an interlocking fastener comprising a tongue and groove mechanism coupling the base band element to the sizing band element, wherein the interlocking fastener comprises a first portion provided on the second end of the base band element body and a second portion provided on the second end of the sizing band element body, wherein the first portion comprises a tongue member extending from the second end of the base band element body and the second portion comprises a groove provided on the second end of the sizing band element body, wherein the tongue member comprises a body with a circular cross sectional shape and wherein the body extends with a longitudinal axis transverse to a longitudinal axis of the base band element body, wherein the tongue member further comprises a raised surface extending about the periphery of the body of the tongue member and wherein the groove comprises a recessed surface corresponding to the raised surface for receiving the raised surface and retaining the tongue member in the groove.

9. The band assembly of claim 8, further comprising a charm with a hollow body configured for receiving at least a portion of the sizing band element body, whereby the charm is selectively mounted on the sizing band element body.

* * * * *